US008052120B2

(12) United States Patent
Bacon

(10) Patent No.: US 8,052,120 B2
(45) Date of Patent: Nov. 8, 2011

(54) MULTIPURPOSE MODULAR LIFT PLATFORM

(75) Inventor: Todd J Bacon, Northville, MI (US)

(73) Assignee: Herkules Equipment Corporation, Walled Lake, MI (US)

( * ) Notice: Subject to any disclaimer, the term of this patent is extended or adjusted under 35 U.S.C. 154(b) by 252 days.

(21) Appl. No.: 12/435,527

(22) Filed: May 5, 2009

(65) Prior Publication Data

US 2009/0278098 A1 Nov. 12, 2009

Related U.S. Application Data

(60) Provisional application No. 61/051,597, filed on May 8, 2008.

(51) Int. Cl.
*B66F 3/35* (2006.01)

(52) U.S. Cl. ..... 254/93 HP; 254/122; 280/43.12; 280/32.6; 180/168; 414/607

(58) Field of Classification Search ..... 254/93 HP, 254/122, 124, 126, 93 R; 280/43.12, 32.6; 180/168; 414/607; 187/269
See application file for complete search history.

(56) References Cited

U.S. PATENT DOCUMENTS

| | | | | |
|---|---|---|---|---|
| 4,243,354 | A | 1/1981 | Garcia | |
| 4,302,023 | A | 11/1981 | Kiesz | |
| 4,488,326 | A | 12/1984 | Cherry | |
| 4,639,005 | A | 1/1987 | Birlkey | |
| 5,299,906 | A | 4/1994 | Stone | |
| 5,482,303 | A | 1/1996 | Meloy | |
| 5,829,948 | A * | 11/1998 | Becklund | 414/607 |
| 6,112,858 | A * | 9/2000 | Arnst | 187/269 |
| 6,286,812 | B1 * | 9/2001 | Cherry | 254/9 C |
| 6,669,214 | B1 | 12/2003 | Domis | |
| 6,857,493 | B2 | 2/2005 | Shupp et al. | |
| 7,070,167 | B1 * | 7/2006 | Bacon et al. | 254/93 HP |
| 7,070,189 | B2 * | 7/2006 | Grauss | 280/32.6 |
| 7,374,184 | B2 | 5/2008 | Worthy | |
| 7,789,811 | B2 * | 9/2010 | Cooper | 482/89 |
| 2002/0043776 | A1 | 4/2002 | Chuang | |
| 2005/0134011 | A1 | 6/2005 | Lin | |
| 2009/0278098 | A1 * | 11/2009 | Bacon | 254/1 |

FOREIGN PATENT DOCUMENTS

| | | |
|---|---|---|
| JP | 09-110391 | 4/1997 |
| JP | 09110391 | 4/1997 |
| JP | 3065742 | 11/1999 |
| JP | 03065742 | 11/1999 |

(Continued)

OTHER PUBLICATIONS

International Search Report, International Application No. PCT/US2009/042833, Sep. 25, 2009, 2 pages.

*Primary Examiner* — Lee D Wilson
(74) *Attorney, Agent, or Firm* — Howard & Howard Attorneys PLLC

(57) ABSTRACT

A vertical lift mechanism (100, 100*a*, 100*b*) including: a lift support assembly (102) comprising an upper frame member (104), a lower frame member (106), the upper frame member is movable between a lowered position and a lifted position. The lift support assembly additionally includes a support mechanism (150) that holds and maintains the alignment between the upper frame member and a lower frame member as well as a powering unit to cause movement of the upper frame.

10 Claims, 12 Drawing Sheets

FOREIGN PATENT DOCUMENTS

| | | |
|---|---|---|
| JP | 2003-128390 | 5/2003 |
| JP | 2003128390 | 5/2003 |
| JP | 2008-56459 | 3/2008 |
| JP | 2005006459 | 3/2008 |
| KR | 1994-0001675 | 3/1994 |
| KR | 2019940001675 | 3/1994 |

* cited by examiner

MULTIPURPOSE MODULAR LIFT PLATFORM

This application claims the benefit of U.S. Provisional Application 61/051,597, filed on May 8, 2008. The disclosure of the above application is incorporated herein by reference.

BACKGROUND AND SUMMARY OF THE INVENTION

The present invention generally relates to lifting mechanisms generally including lifts, jacks, and lift or lifting platforms, each of these terms are used interchangeably herein.

Industrial lifting platforms provide a powerful mechanism to lift and or otherwise orientate machinery, manufactured parts, pallets, boxes and the like. These devices also serve as adjustable platforms for operators as well. The prior art including U.S. Pat. No. 7,070,167, shows a variety of different types or classes of industrial lifts including stationary lifts, mobile lifts, lifts with fixedly secured platforms as well as lifts with platforms capable of tilting about a horizontal axis as well as rotating about a vertical axis. Each of these lifts is built to a fixed design to achieve a basic purpose and is not convertible or reconfigurable from one class of lift to another.

The manufacturer, distributor or customer of these various lifts must maintain and/or purchase an extremely large inventory of fully assembled lifts or parts therefor to enable the manufacture, assembly and use of a large set of products. The present invention has as one of its goals the reduction of inventoried parts while still enabling the assembly of a wide variety of lifts including those mentioned above. The present invention shows how the above mentioned lifts can be assembled utilizing modularity which permit for example starting with one type of basic lift and converting or reconfiguring its purpose and functionality.

More particularly, the present invention comprises in a first embodiment: a vertical lift including an upper frame member, a lower frame member, and the upper frame member is movable by a powering unit between a lowered position and a lifted position. The lift additionally includes a support mechanism that maintains the alignment of the upper frame member and a lower frame member. The powering unit is also referred to as a force generating subassembly. As can be appreciated the support mechanism can also be part of the power unit.

In the illustrated embodiment the support mechanism comprises a plurality of scissor mechanisms which primarily serve to support the upper frame and to maintain the alignment between the upper and lower frames. In the illustrated embodiment the scissor mechanisms are part of a lift support assembly and as such the illustrated lift is often referred to as a scissor lift. The powering unit or force generating subassembly in some of the illustrated embodiments is achieved by a plurality of inflatable chamber's (which resemble tires, air bags or bellows) that act directly between the upper and lower frames. The invention encompasses other support mechanisms and powering units. The lift is configured to accept one of a plurality of modular element or units to vary the functionality of the lower frame member and/or the upper frame member creating various lifts to provide commercial and functional flexibility and easily meet varying customer demand. In the illustrated embodiments the lift has a one-to-one ratio lift, with high lifting capacity, employing air bag (bellows) having diameters of up to 0.76 m (30 inches) to achieve a low profile, rapidly responsive lift. The lift is engineered to maximize structural strength and reduce cost by optimally placing steel elements in critical locations throughout the lift as opposed to increasing the size and weight of all of the components.

DETAILED DESCRIPTION OF THE DRAWINGS

Figure 1:
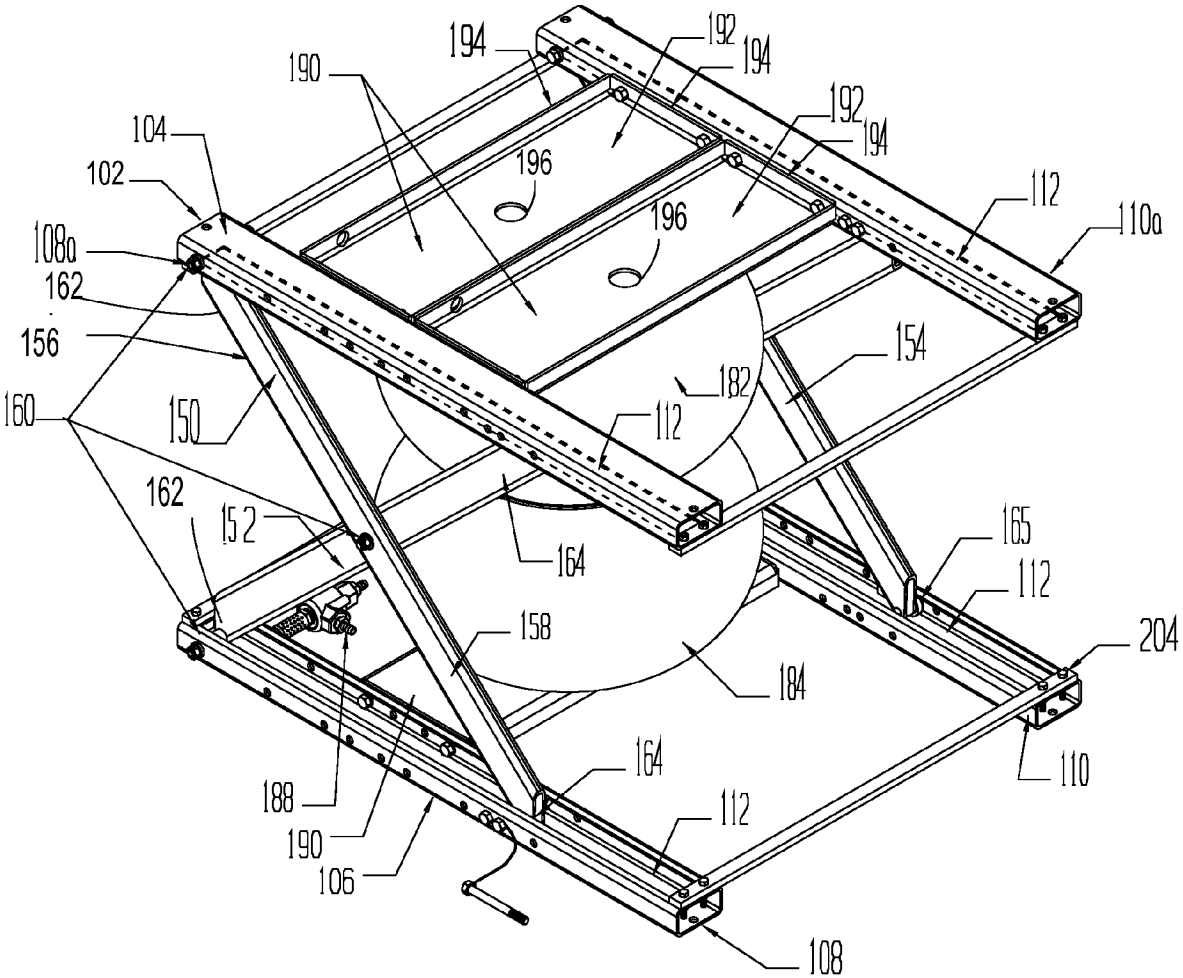
FIG. 1 shows a basic lift forming part of the present invention.

FIG. 1 shows a vertical or scissor lift mechanism 100 usable with the present invention, the lift includes reconfigurable parts. This illustrated lift mechanism is a stationary lift, which vertically lifts a work piece from one position to another. The lift mechanism 100 includes a lift support assembly 102. The lift support assembly includes an upper frame 104 and a lower frame 106. The lower frame includes two reconfigurable support frame members 108 and 110. The support frame members 108 and 110 can be extruded tubes, preferably metal, which in cross-section, are generally box-shaped. An open channel or slot 112 is formed in each of the members 108 and 110. Members 108 and 110 are arranged parallel to each other and spaced apart. The upper frame 104 is similarly configured with two parallel and spaced apart frame members 108*a* and 110*a*, each member also generally box-shaped in cross-section with an open channel 112 formed therein. Respective portions of the scissor-lift mechanisms are received within the various open channels 112.

Each of the lower and upper frames 104 and 108 additionally include reconfigurable crossbars 120 and 122. In the embodiment shown in FIGS. 1 and 1*a*, the crossbars are removable and secured to opposing ends of the spaced-apart frame members 108-110 for the lower frame and 108*a*-110*a* for the upper frame. The frame members and crossbars used in each of the lower frame 106 and the upper frame 104 are interchangeable reducing the parts-count needed in inventory needed to convert one type of lift mechanism into another.

As mentioned above the lift mechanism 100 may include a scissor-lift mechanism receivable in slots 112. In general the scissor-lift mechanism is also called a connecting mechanism 150 as it connects, guides and aligns portions of the upper and lower frames. The illustrated connecting mechanism 150 includes a first scissor mechanism 152 movable within the channels 112 in the frame members 108 and 108*a* and a second scissor mechanism 154 movable within the channel 112 in frame members 110 and 110*a*. Scissor mechanism 152 includes two bars 156 and 158 that are pivoted about a joint or pivot generally shown as 160. Ends 162 of bars 156 and 158 cannot slide and are respectively rotationally connected to frame members 108 and 108*a* at hinge points 161. Ends 164 of the two bars 156 and 158 are configured to slide within the opening channels 112 as the first scissor mechanism 152 moves from a lowered to a raised position within frame members 108 and 108*a*. Each end 164 is connected to a roller 165 to facilitate movement of ends 164. The second scissor mechanism 154 is identically configured relative to the frame members 110 and 110*a*. The bars 156 and 158 and other parts forming the two scissor mechanisms 152 and 154 are also interchangeable further reducing parts count in inventory.

The illustrated lift mechanism 100 includes a powering unit (force generating subassembly) or mechanisms 182, 282 and 382 when operated cause the upper frame to move relative to the lower frame. The illustrated powering unit operates directly on the upper frame member and on the lower frame member. Alternately, the powering unit can apply a force or torque to one or more of the bars 156, 158 of the various scissor mechanisms urging the bars of a particular (or both) scissor mechanism(s) to more apart or closer together thereby controlling the height of the upper frame member 104. The force generating subassembly can be hand powered such as hand crank (not shown), or powered (see FIG. 7) by an electric motor with a transmission such as a ball screw, a pneumatic and/or hydraulic cylinder or air chamber or bellows depending upon the needs and resources.

Figure 2:
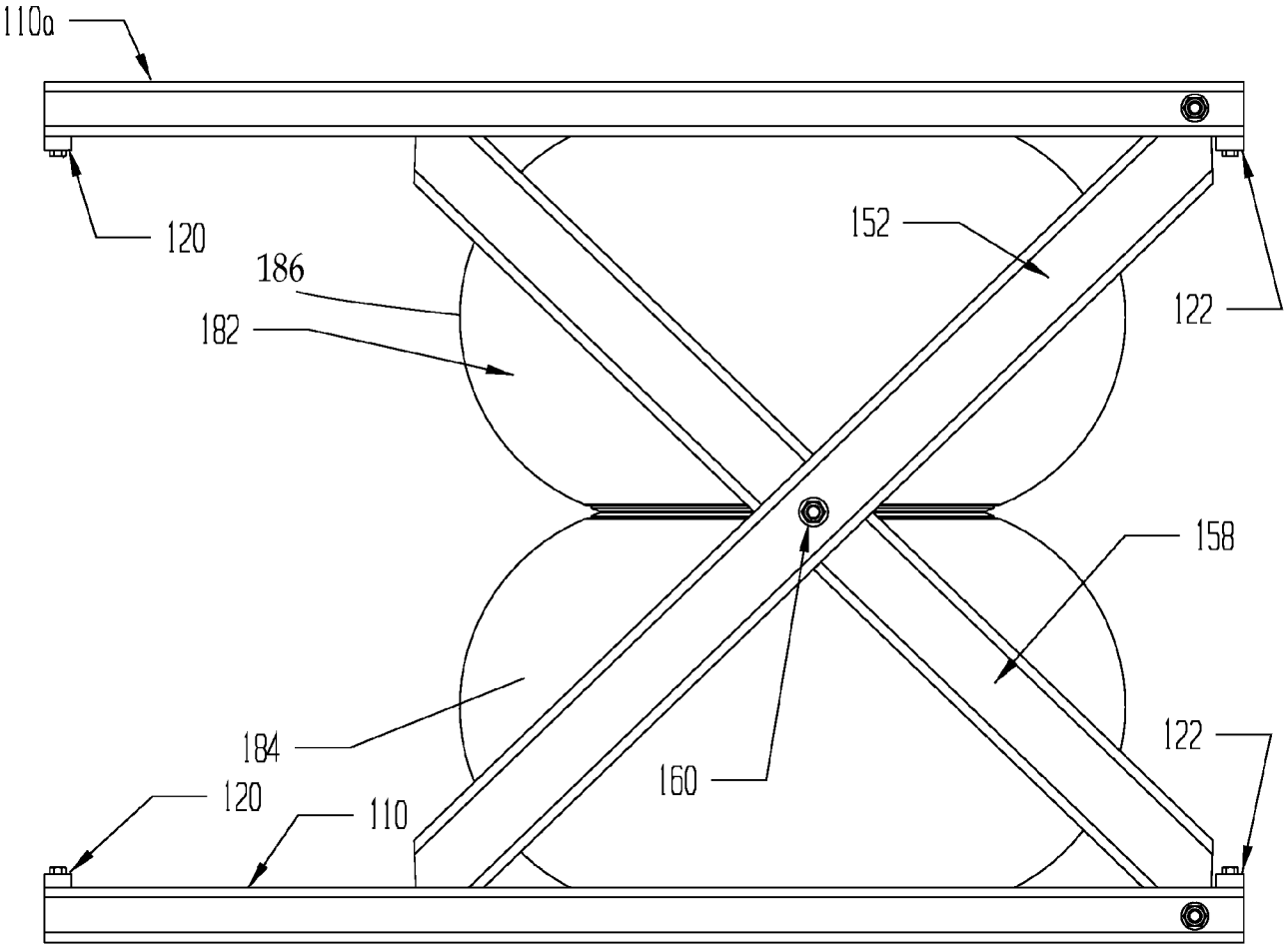
FIG. 2 shows the lift in an elevated position.
Figure 2A:
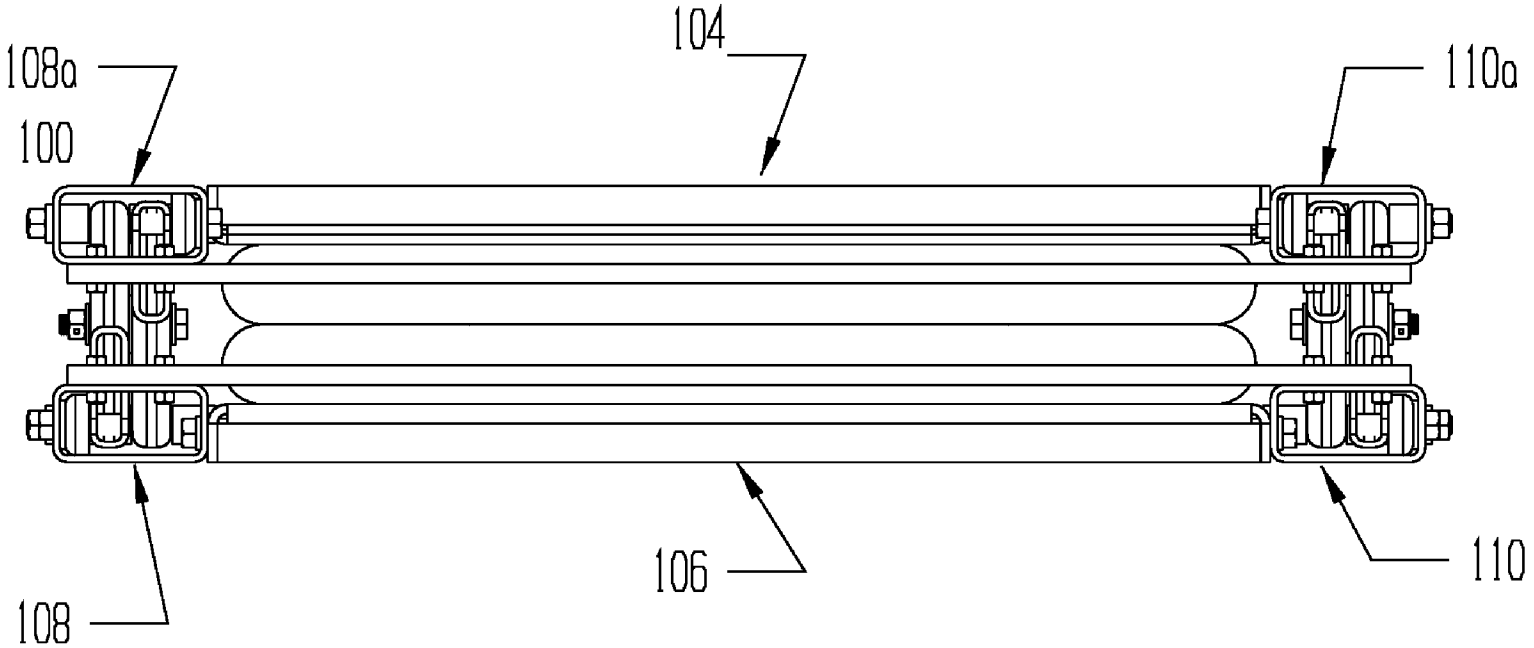
FIG. 2*a* shows the lift in a lowered position.

The powering unit 180, as illustrated in FIGS. 1, 2 and 2*a*, includes an inflatable bellows 182 which when inflated by compressed air raises the upper frame 104 relative to the lower frame 106. To accommodate the bellows 182 the upper and lower frames include rectangular metal stampings, members or plates 190 attachable to the upper and lower frames. Each stamping, member or plate 190 has a flat surface 192 and four depending sides 194 (to facilitate attachment). Two of the sides are respectively secured to a corresponding side of frame members 108 and 110 of the lower frame and 108*a* and 110*a* of the upper frame. One or more stampings, members or plates 190 can be secured to the upper and/or lower frame. By way of example, one stamping 190 is secured to the lower frame and two stampings to the upper frame. Each surface 192 may include one or more openings 196. The bellows acts between opposing surfaces 192 of the stampings 190 secured to the lower frame 106 and to the upper frame 104. Bellows 182 may include multiple inflatable chambers including inflatable interconnected rubbers tires 184 and 186 which are known in the art, which receive pressurized air from a source of pressure such as a compressor though an air valve assembly 188. The valve assembly 188 is communicated to the bellows 182 through hoses or pipes which extend through one of the openings 196. In FIGS. 2 and 2*a* the lift mechanism 100 is shown in an elevated position and in a lowered position.

Figure 7:
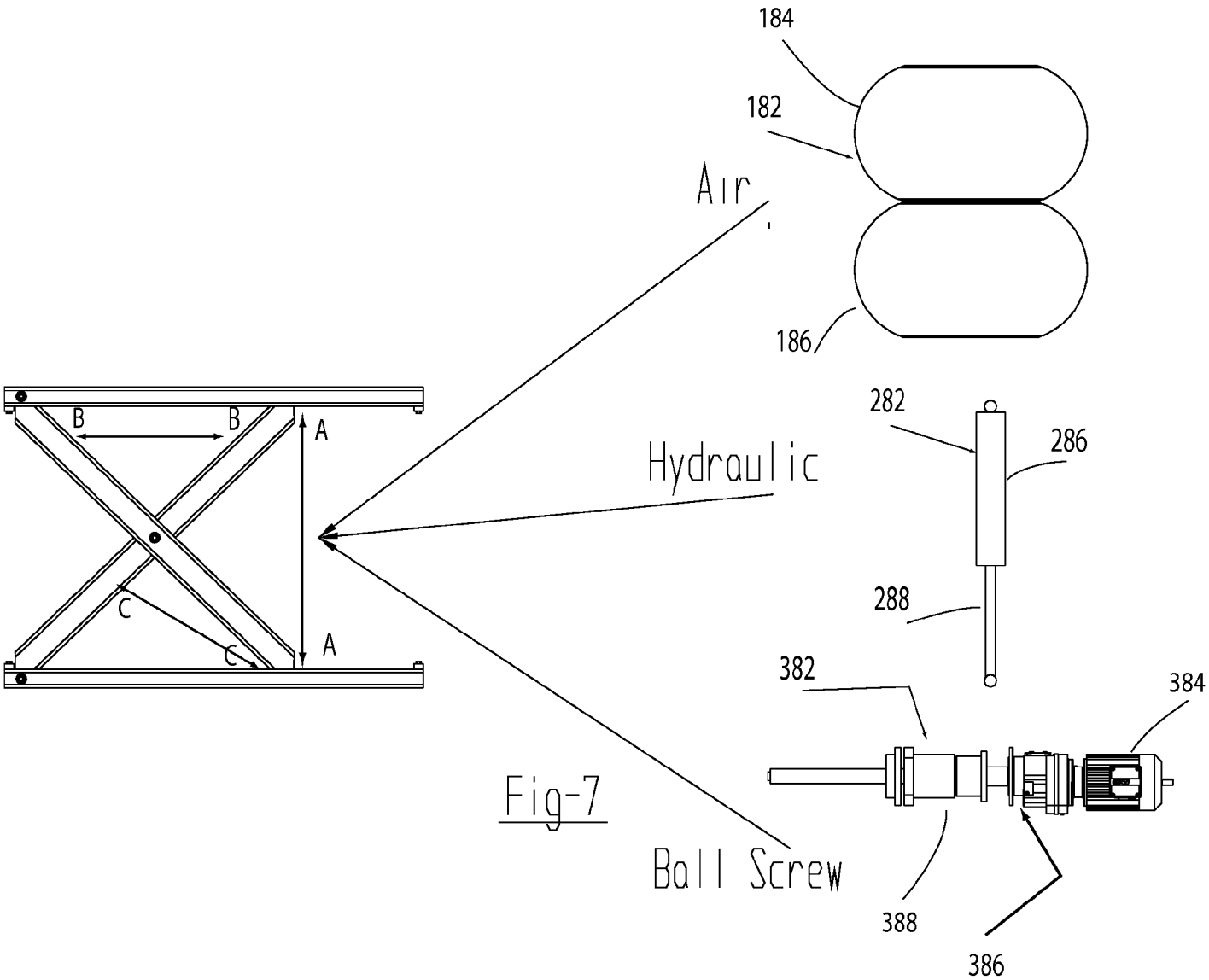
FIG. 7 shows a number of power units usable with the present invention.

Reference is briefly made to FIG. 7, which diagrammatically shows alternate powering units (which can also be considered as powering modules) usable with the present invention including the bellows 182 as mentioned above. Additionally, the powering unit (force generating subassembly) can be a hydraulic device 282 with a movable piston 284 and hydraulic cylinder 286. The hydraulic device can be placed between the upper and lower frame applying force directly thereto (at the location of arrows A-A) in the manner the bellows is shown in the various figures or placed between the scissor elements (at the location of arrows B-B)_or between a scissor element and one of the upper or lower frames (see arrow C-C). FIG. 7 also shows electrical force generating unit 382 including an electric motor 384 and a transmission 386 such as a ball screw mechanism 388 that can be connected to the lift in the various ways suggested for the hydraulic device.

Figure 3:
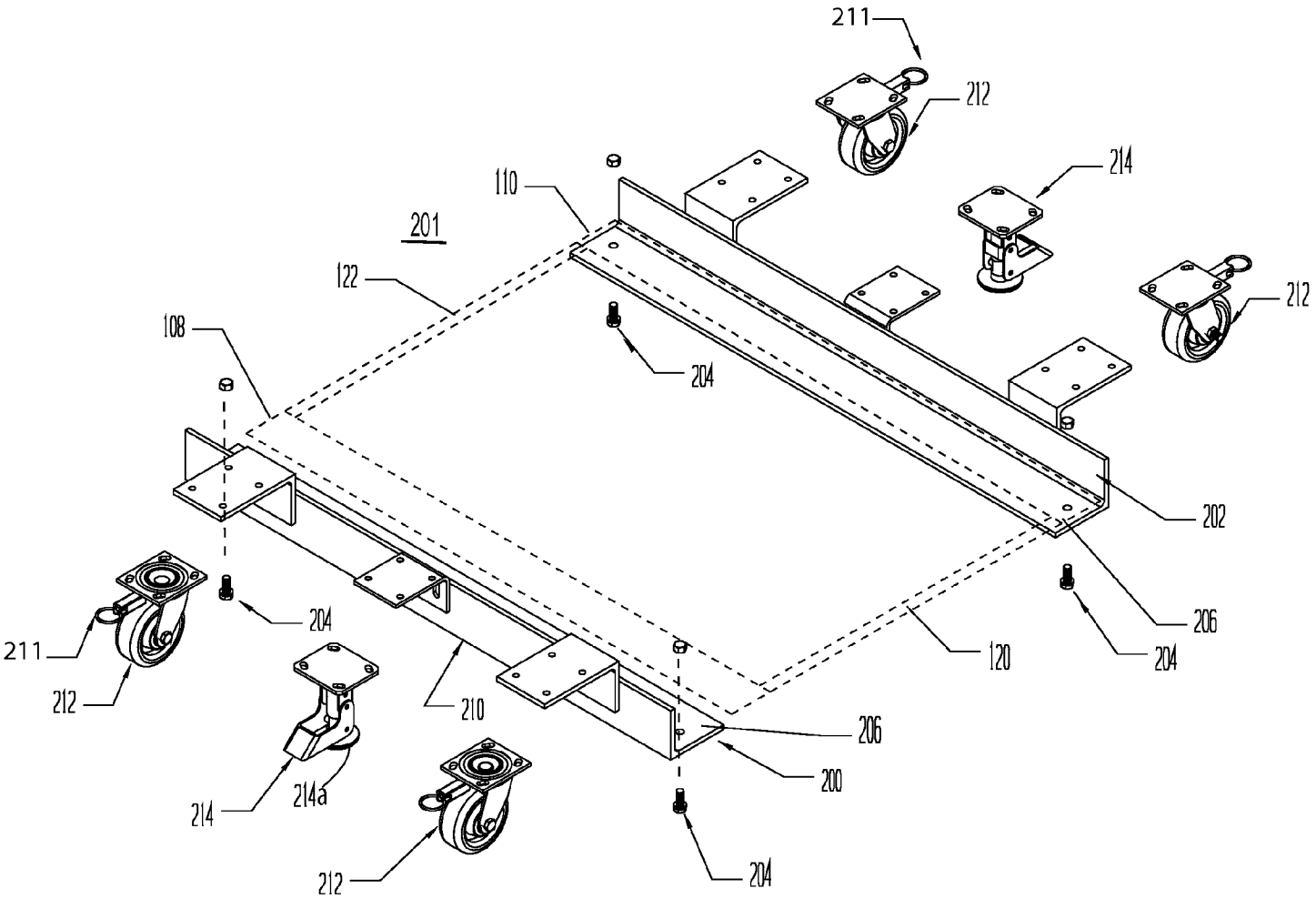
FIG. 3 shows an alternate embodiment of the invention enabling the lift of FIG. 1 to be moved laterally using a carriage module.
Figure 3A:
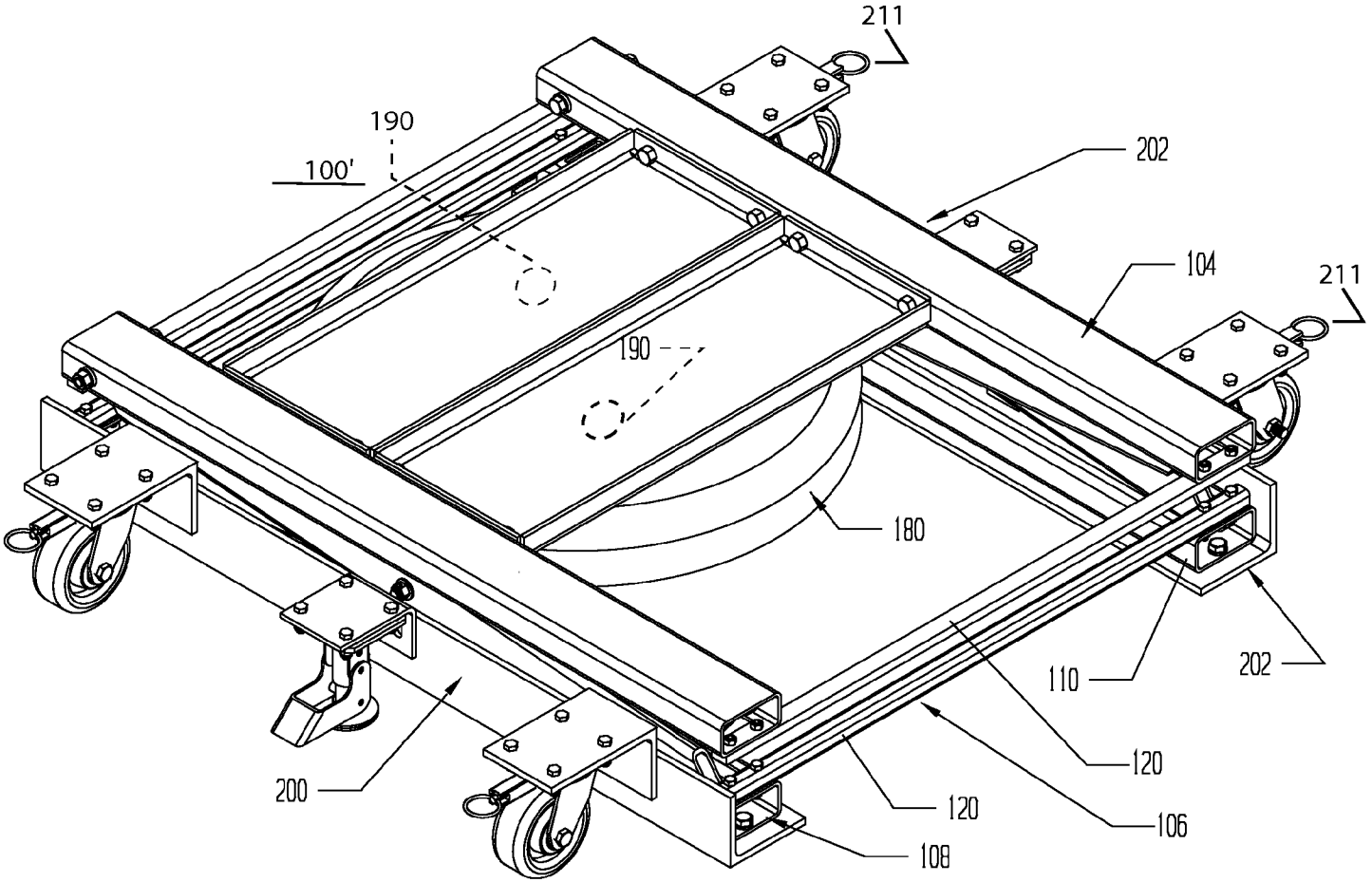
FIG. 3*a* shows the carriage module referred to in FIG. 3 under a vertical lift.

Reference is now made to FIG. 3 which shows how the functionality of the lower frame 106 including the frame members 108 and 110 are reconfigured and repurposed. More specifically, FIG. 3 illustrates a carriage module 201 comprising two carriage members 200 and 202 each of which are adapted to be positioned under lower frame 104, and more particularly under frame member 108 and/or frame member 110 and preferably secured to these frame members utilizing one or more removable fasteners 204, such a threaded fastener (bolt and nut) received in a threaded opening in frame members 108 and 110. The use of fasteners as mentioned is preferred to permanently secure a carriage member to the lower frame 106 and permits the lift 100 and carriages to move as an integral unit. However, another alternate of the present invention is to slide the carriages below the lower frame using the weight of the lift to maintain the carriages in the correct orientation, thereby eliminating the need for such fasteners. Each carriage member is formed with a lower support surface 206 which is configured to extend under frame member 108 and/or or frame member 110. In the illustrated embodiment the lower support surface 206 is part of an L-shaped steel bracket 210. As can be appreciated the carriage members are identical and interchangeable which reduces parts count and inventory. Each carriage member 200 and 202 is configured to receive two casters (wheels) 212 and a locking or break device 214 which when activated prevents the frame from rolling on the wheels. The casters enable the lift mechanism 100' (see FIG. 3*a*) supported on the carriage members to be moved laterally. The locking or break members hold the carriage members and lift mechanism at the desired location by interacting with the floor (such as by forcing a pad 214*a* against the floor) in a known manner. The locking or break device 214 can be incorporated within the casters which when activated prevents the caster (wheel) from rotating. As can be seen from the above, the carriage members 200 and 202 add additional functionality to the frame members 104, 106, 108 and 110 converting a stationary lift mechanism 100 into a mobile lift mechanism with the addition of modular carriage members or units. The two carriage members are sometimes referred to collectively as a carriage 201. Reference is briefly made to FIG. 3*a* which shows the carriage members or units 200 and 202 secured to lift 100. In FIG. 3*a* the upper frame is shown in a lowered position. FIG. 3*a* also shows that if desired, the stamping 190 need not include an opening such as 190 shown in phantom line, but if this alternate is chosen one added part (the stamping without opening) is added to inventory. FIGS. 3 and 3*a* show a plurality of tie-down loops 211 which can be used to further secured the lift mechanism too the floor.

Figure 1A:
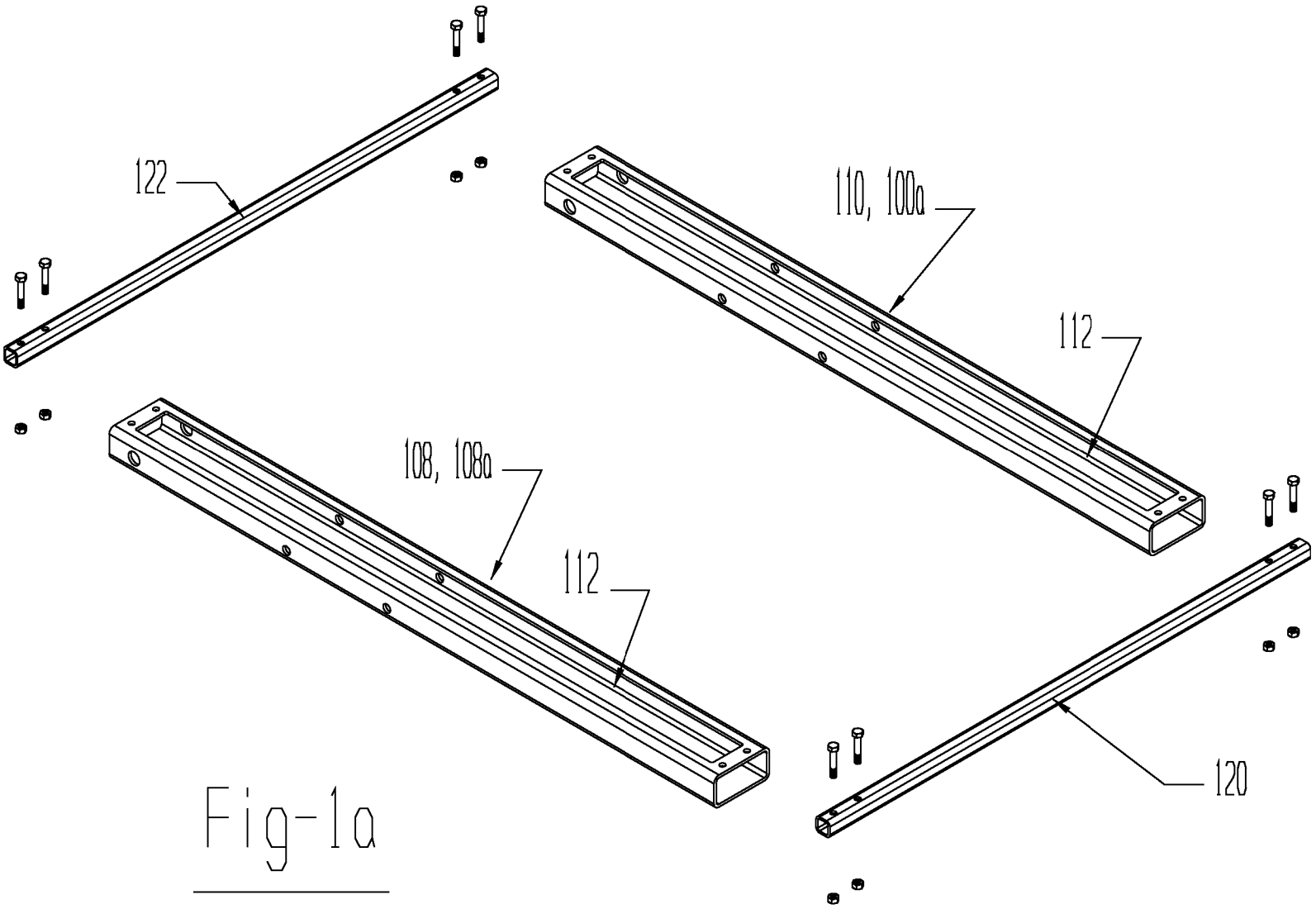
FIG. 1*a* shows a lower frame of the lift of FIG. 1 in greater detail.
Figure 4:
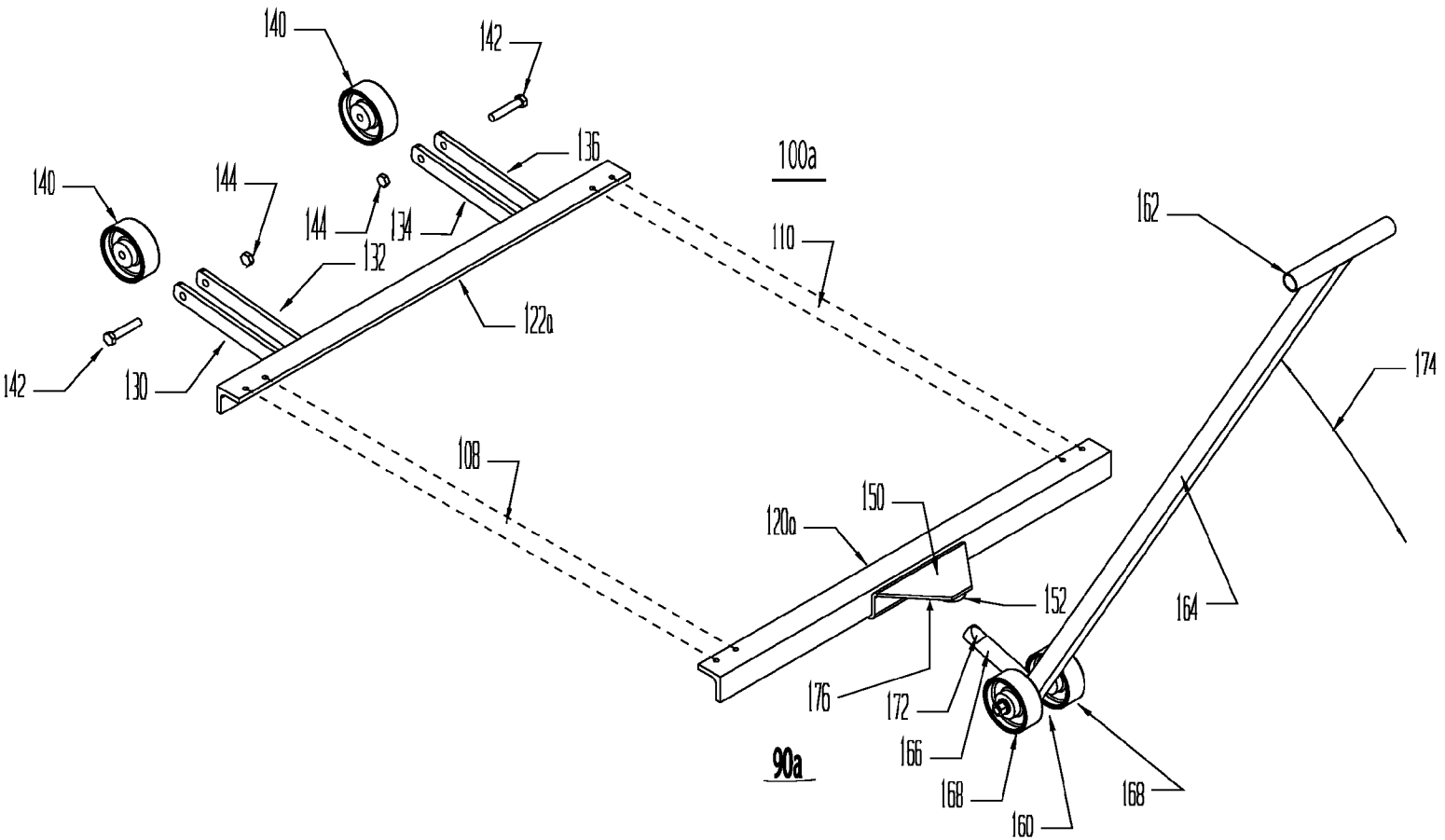
FIG. 4 illustrates details of a dolly modular unit.

The function performed by the cross members or crossbars 120 and 122 lift mechanisms 100 and 100' is to maintain the proper spacing between the lower frame members 108 and 110 as well as 108*a* and 110*a*. FIG. 4 illustrates another add-on or replacement modular unit such as a dolly module 90 comprising a front wheeled section and a rear dolly section. This module 90 can also be used to convert a stationary lift into another mobile lift mechanism 100*a*. In this embodiment, crossbars 120 and 122 shown in FIGS. 1 and 1*a* are replaced by crossbars 120*a* and 122*a*. As can also be appreciated, the crossbars 120 and 122 need not be replaced, in which case crossbars 120*a* and 122*a* can be secured on top of the crossbars 120 and 122. In the illustrated embodiment the alternate crossbars 120*a* and 122*a* are secured directly to the lower frame members 108 and 110 using the same fasteners used to secure crossbars 120 and 122 (obviously with crossbars 120 and 122 removed). Crossbar 122*a* is shown in the form of an L-shaped bracket configured to be secured to the frame members 108 and 110 by one or more threaded fasteners. Crossbar 122*a* further includes two sets of extending spokes 130, 132 and 134, 136. A wheel such as 140 is secured between each set of spokes and appropriately secured thereto, such as by utilizing a shoulder bolt 142 and nut 144. Crossbar 120*a* is also formed using an L-shaped bracket configured to also be secured to lower frame members 108 and 110 opposite crossbar 122*a*. Crossbar 120*a* includes a further L-shaped flange or bracket 150 having a projection 152 such as a hitch, ball or pin, protruding from its underside. The above components are designed to cooperate with a manually movable dolly generally shown as 160. The dolly includes a handle 162 and handle bar which forms a first lever 164 operatively connected to a smaller lever 166 at a pivot point formed by an axis extending through casters (wheels). The levers are supported by a plurality of casters (wheels) 168. The above crossbars in combination with the dolly 160 convert the normally stationary lift mechanism 100 into a mobile lift mechanism 100*a* as more particularly illustrated in FIG. 4*a*. As can be appreciated, by securing the wheels 140 and projection 152 to respective cross-bars the spacing between the wheels and projection is maximized. The cross-bars 120*a* and 122*a* can be secured to the lower frame members 108 and 110. In this case cross-bars would not be removed.

Figure 4A:
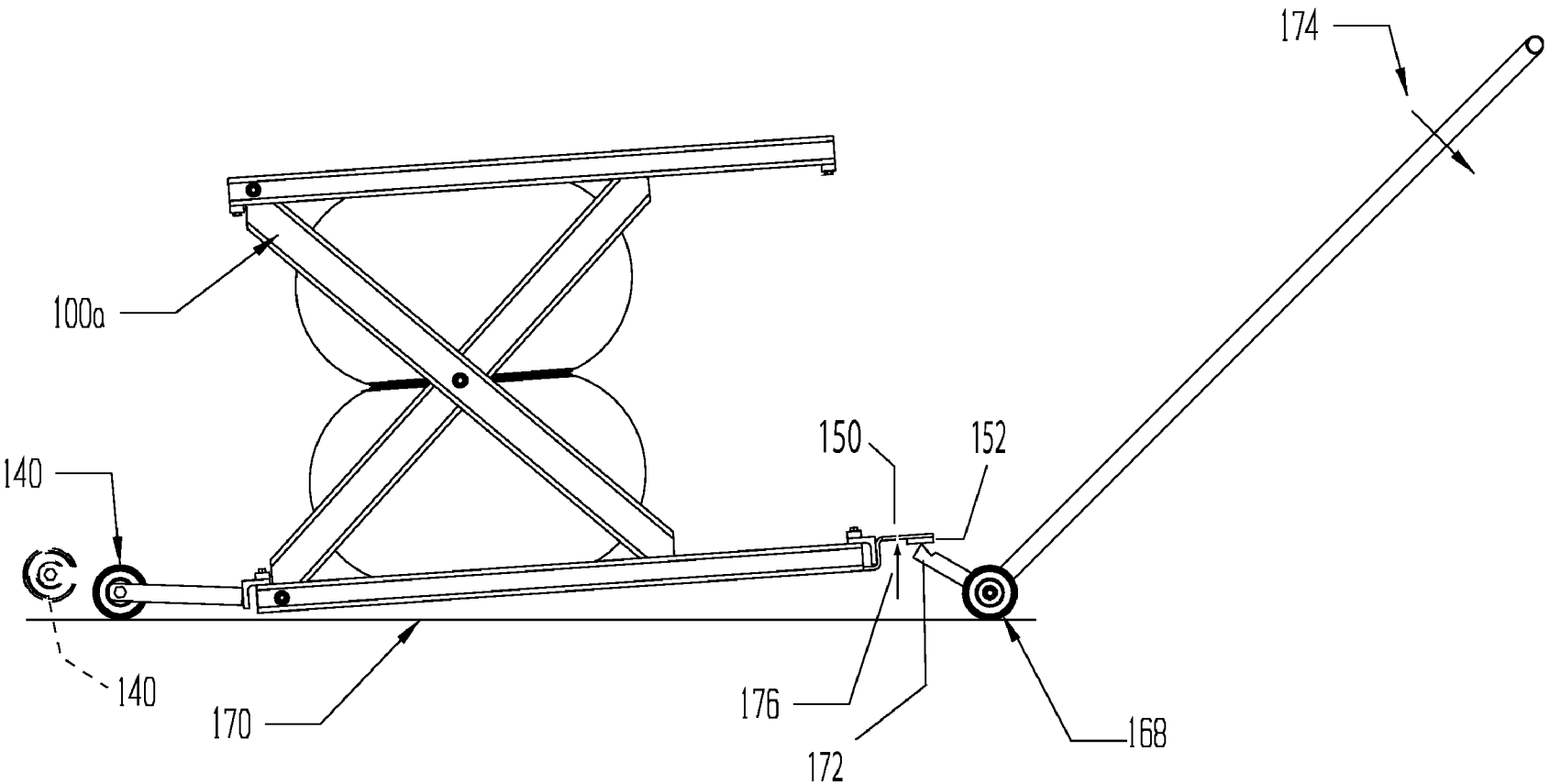
FIG. 4*a* shows a vertical lift, lifted by a modular dolly unit.

When lift mechanism 100*a* is located on the support surface (such as the floor) 170 in its normal operating condition, both wheels 140 are elevated from the support surface 170 and the lower sides of members 108 and 110 rest upon the surface 170 in FIG. 4*a*. The elevated condition of the wheels is diagrammatically grammatically shown by phantom wheel 140 elevated from surface 170 also in FIG. 4*a*. With the lift 100*a* in this configuration the bracket or flange 150 is designed to be elevated from the floor 170. When it is desired to relocate lift mechanism 100*a*, the dolly is manipulated so that the smaller lever 166, see FIG. 4, is below the projection 152. Dolly 160 includes a connector of known construction that is engageable with projection 152; this connector is generally shown by 172. With the dolly in the position as described, the handle bar i.e. the long lever 164 is pushed downwardly generally shown by arrow 174 in FIG. 4*a*, creating an upward force, see arrow 176, lifting flange 150 off of the floor, tilting lift mechanism 100*a* and placing the wheels 140 on the surface 170. In this condition the lift mechanism 100*a* is now supported by the two sets of wheels 140 and 168 and can be moved laterally to a new work location at which time the dolly is removed and lift 100*a* will once again rest on the floor.

When the upper frame 104 of lift mechanism 100 is moved up and down, the upper frame maintains a horizontal orientation and functions to move its cargo (or occupant standing thereon) from one vertical position to another; this is true of lift mechanisms 100' and 100*a* as well. The following embodiment illustrated in FIGS. 5, 5*a* and 5*b* modularize the functionality of the upper frame 104 and enable a work piece such as a storage container to first be mounted to any of the above lift mechanisms, and if desired tilted to desired orientation toward or away from a worker enabling the worker to ergonomically fill or remove products into or from the storage container.

Figure 5:
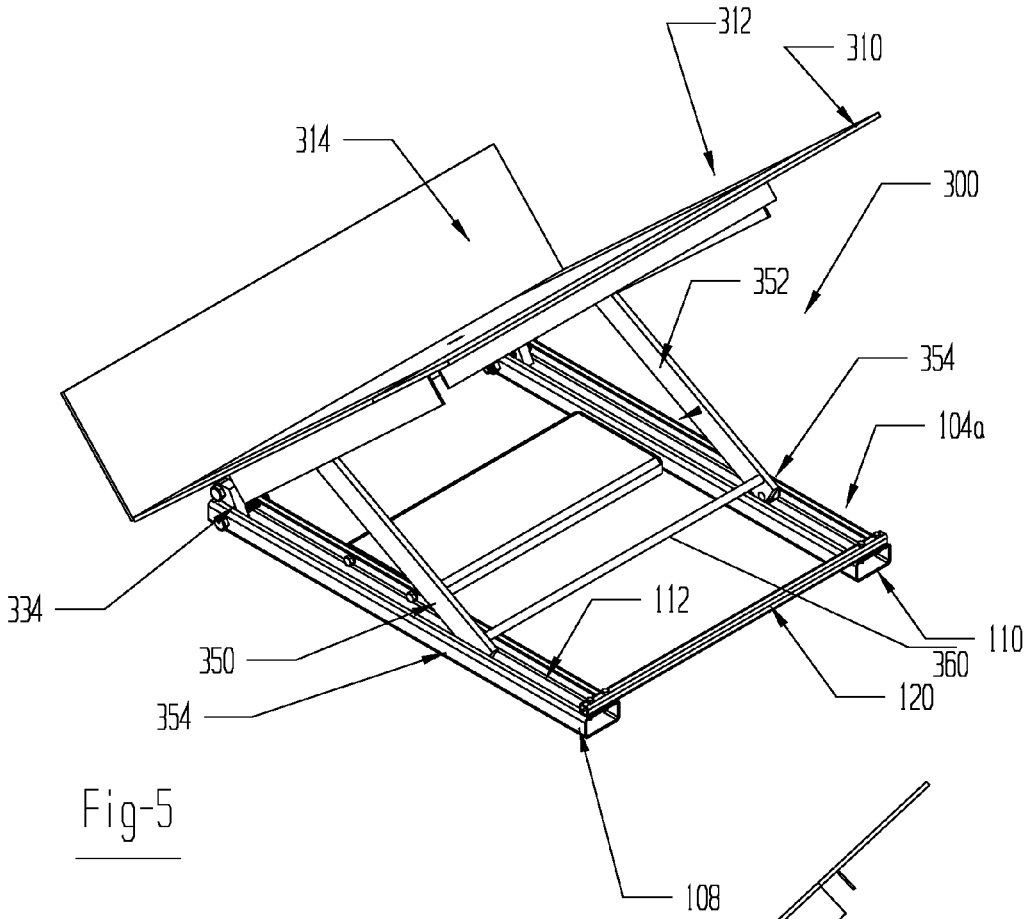
FIGS. 5, 5*a* and 5*b* show a lift with the addition of a modular tilt mechanism.
Figure 5A:
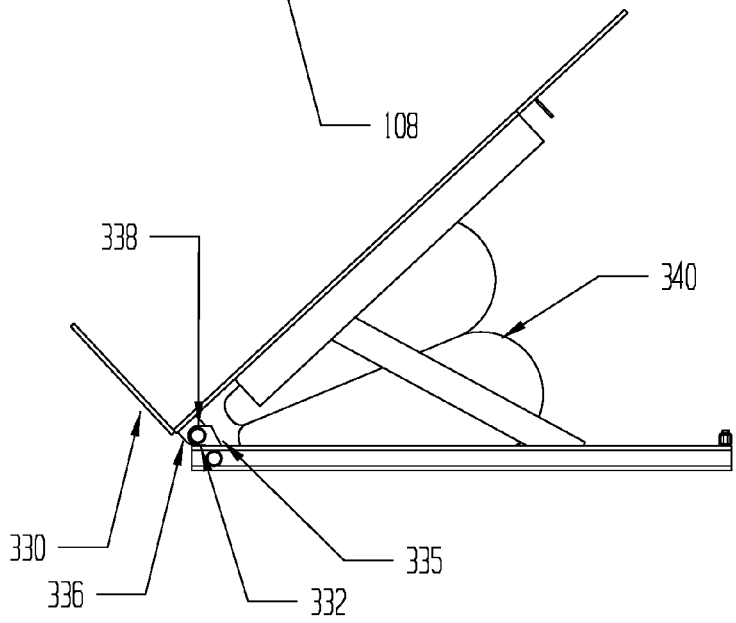
Figure 5B:
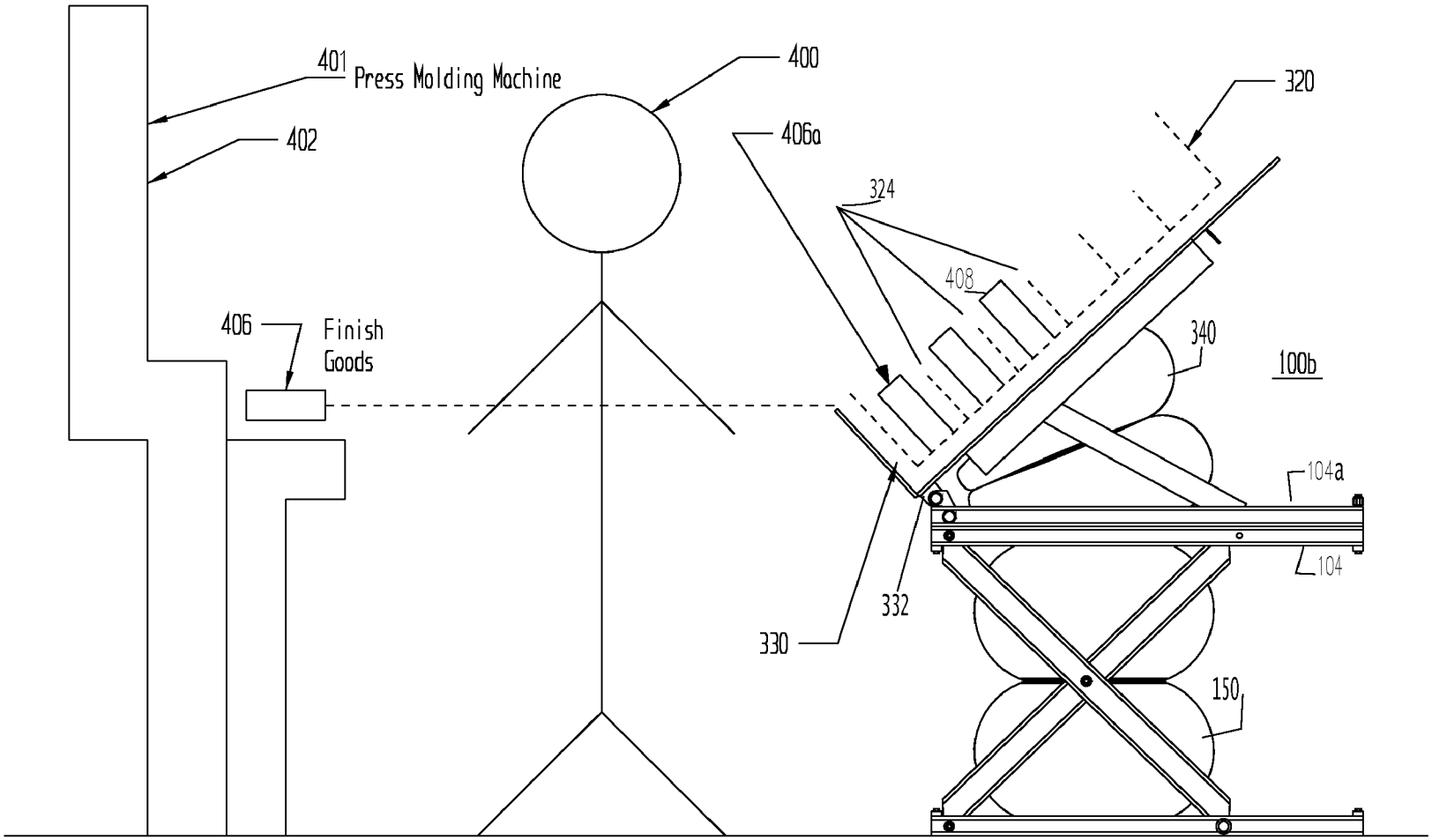

FIG. 5 shows a modular tilt mechanism 300 and includes a supplemental upper frame 104*a* that is configured to be connected to the first mentioned upper frame 104. The supplemental upper frame 104*a* is constructed of support members 108, 110 and crossbars 120 and 122 as is the case with the upper frame 104. As can be appreciated this construction also serves to minimize the number of parts needed inventory. The tilt mechanism 300 includes a table 310 having a first support member 312 and a second support number 314. When the tilt angle is 0°, member 312 is horizontal while member 314 is vertical. In this orientation a storage container 320 (shown in FIG. 5*b*) can easily be placed upon the table 310. The storage container, see FIG. 5*b* can include one or a plurality of partitions 322 into which products can be placed. End 330 of table 310 is secured to the supplemental upper frame 104*a* using two opposing hinges 332, only one of which is shown in the many figures, the other hinge being of identical in construction. The hinged table 310 is movable from a horizontal or zero degree position to an elevated position. The hinged table can be moved to different positions by many known force generating subassemblies including pneumatic, hydraulic cylinders or electric motors. In FIGS. 5, 5*a* and 5*b* the power unit (force generating subassembly) 340 for the tilt mechanism is one or more inflatable chambers or tires, similar in construction and operation to lift mechanism 150. As can be appreciated the other power units 282 and 382 can also be installed in the tilt mechanism further increasing the modularity of the present invention yielding additional members of the family of lift mechanism.

The lower portion 334 of hinge 332 is formed by a metal block 335 that is received within the end of slot 112 in each of the support members 108 and 110. The blocks 335 are secured to each of the frame members 108 and 110. The upper portion 336 of each hinge 332 includes a projecting arm 338 that is rotationally fitted to the lower portion 334, a pin extends through the upper and lower portions to provide the hinge. As the chambers of the device 340 are inflated the table moves from one angular orientation to another. The supplemental upper frame 104*a*, as a module, is fixedly secured to the upper frame 104 such as be bolting the facing frame member 108 and 110 together or by bolting facing standings 190 together. The tilting mechanism 300 additionally includes two identical, hinged bars 350 and 352 each having an end 354 slidably received within a slot 112. Each end may be supported on a roller such as 165 in the manner shown in FIG. 1. To maintain the coordinated movement of ends 354 each end is connected to the other by a crossbar 360. As table 310 is moved to its lowest position ends 354 will move to the right-hand side of slot 112 relative to FIG. 5*a* and when the table 310 is moved to its maximum angular positioned the ends will achieve the orientation as illustrated for example in FIG. 5*b*. In the situation where the weighted load on the table 310 is known to be low, the powering units 182, 282 and 382 can be eliminated and table moved manually. In this embodiment the lower end of each bar 350 and 360 can be pinned in place or a ratchet mechanism included in the frame members 108 and 110 of the tilt mechanism to hold the table 310 in its desired location until later changed.

In FIG. 5*b* a lift 100*b* with the tilt mechanism 300 is shown next to an operator/worker diagrammatically illustrated by 400. The operator is positioned between the tilt mechanism and production machine 401 such as a stamping press or molding machine, the output of which is a partially finished or finished products or goods 406. The operator 400 takes this product and inserts same into either into the container or into one of the partitions 322, if provided, in the storage container 320. As can be appreciated if the worker 400 found it inconvenient or unsafe to insert an additional work piece shown as 408 into another or second row of the storage container the worker now has the ability to raise or lower the lift mechanism 100*a* and to also change the angular orientation of the table 310. For example, when a second or upper row is positioned further away from the operator 400 the operator might stretch too far and injure himself/herself. To avoid this the operator 400 can now cause the lift mechanism 110*b* to achieve a different vertical position (up or down) thereby changing the relative position of the storage box 320. If this did not result in a more efficient condition to access the second or upper row, the position of the tilt mechanism can be varied again making it more convenient and safe for the operator to insert the product into an upper row. In this manner the operator can control the angular orientation and vertical height of the container to enhance placement of product therein or removal of product therefrom and to accomplish this function in a safe manner. As can also be appreciated the basic lift mechanism 100*b* with modular tilt mechanism 300 can also be converted to one of the mobile lifts mentioned above. Further, the powering units can be one of the above mentioned variations (bellows, pneumatic, hydraulic, electric or manual).

Figure 6:
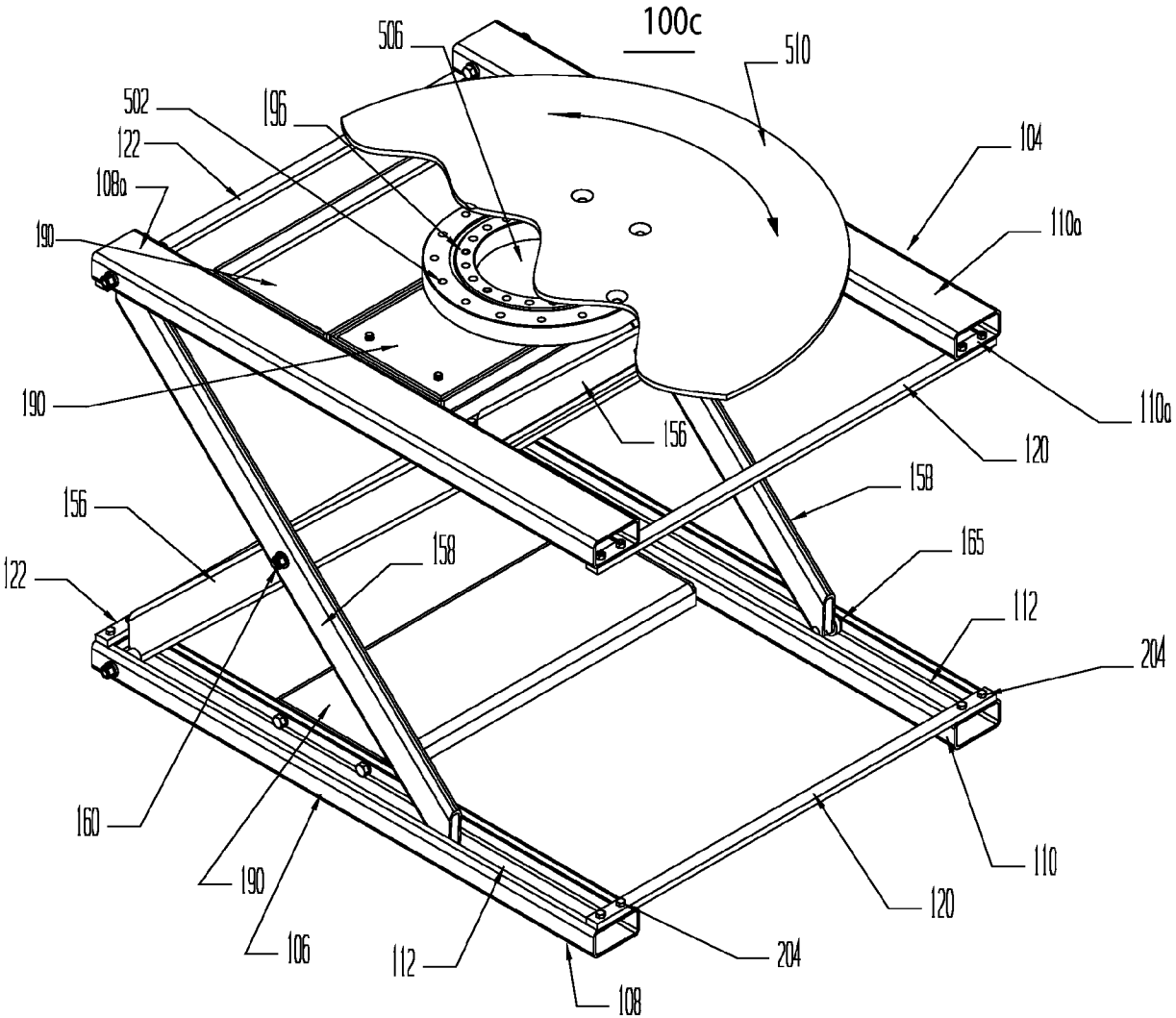
FIG. 6 shows a lift with the addition of a rotary platform.

Reference is made to FIG. 6 which illustrates a further embodiment of the invention in which the function of the upper frame 104 is converted from a stationary platform to a rotary platform with the addition of a modular rotary unit. FIG. 6 again shows a lift 100*c* using the basic lift 100, with the powering unit removed. The upper frame 104 is configured to receive a rotary platform modular unit 500 comprising a rotary ball bearing or bushing member 502 comprising an inner and an outer race that is capable of rotating relative to the inner race. The inner race can be secured to the upper frame 104 by one or more bolts or fasteners 506. Bolt 506 can extend from opening 196 (in the inner bearing race) through or in one of the steel stampings 190. A circular (or other shaped) platform 510 is secured to a movable with the bearing 502. The lift with the rotary unit 500 is referred to by number 100*c*. As can be appreciated the lift mechanism 300 can be secured to the rotary unit 500 further increasing the family of lift mechanisms. This new combination can be stationary or mobile and powered by any of the powering units mentioned above.

From the above it can be appreciated that a family of operationally flexible, lift mechanisms can be fabricated using modular components according to the teachings of the present invention.

The invention claimed is:

1. A vertical lift comprising:

upper frame member, a lower frame member, and a lift mechanism configured to change vertical spacing between the upper and lower frame members from a first position to a second position, the upper or lower frame member or parts thereof being reconfigurable or configured to accept a modular unit; and at least one modular unit configured to operate in conjunction with the lower frame or the upper frame for changing functionality of one or both of the lower frame member or the upper frame member;

wherein one of the modular units is a lower frame modular unit configured to attach to the lower frame to vary the functionality of the lower frame from resting immovably upon a support surface to: a) horizontally translatable relative to the support surface on wheels supported from first location to a second location or b) temporally lifted off the support floor onto a wheeled support and translatable from the first location to the second location and lowered back onto the support surface at the second location;

wherein the lower frame includes a first and second frame bar spaced apart, each bar including a first and a second end, the lower frame including removable first and second cross-bars attached to the first and second frame bar, wherein the modular unit includes a removable third crossbar to replace the first cross-bar mountable and a fourth cross-bar to replace the second cross-bar; wherein a pair of wheels extends from the third crossbar and wherein a dolly lift mechanism is operably connects with the fourth cross-bar and the dolly lift mechanism is configured to lift the lower frame at the pair of walls.

2. The lift according to claim 1 wherein one of the modular units is an upper frame modular unit including one or more modular units configured to attached to the upper frame member to: a) provide a platform rotatable about a vertical axis relative to the upper frame member, b) provide a platform rotatable about a horizontal axis relative to the upper frame member and c) provide a platform rotatable about a horizontal axis and also rotatable about a vertical axis.

3. The lift according to claim 1 wherein the lower frame member includes a first frame bar and second frame bar spaced apart from each other, each frame bar including a first and a second end, the lower frame including removable first and second cross-bars attached to the first and second frame bar, wherein portions of the modular unit replace the first and second cross-bars.

4. The lift according to claim 1 wherein the lower frame includes a first and second frame bars spaced apart from each other and wherein the modular unit includes a carriage configured to be placed below the frame bars to raise the lower frame member above the support surface, the carriage including a set of wheels or casters to enable lateral movement of the lift.

5. The lift according to claim 4 wherein the carriage includes a brake prevent the lift from moving.

6. The lift according to claim 4 wherein the carriage include a first and second carriage member each carriage member receivable under a different portion of the lower frame member, each of the first and second carriage members including wheels or casters.

7. The lift according to claim 1 wherein the dolly lift mechanism includes at least one wheel.

8. The lift according to claim 2 including a modular rotary bearing unit configured to attach to the upper frame member, the unit including a the platform which is rotatable about a vertical axis relative to the upper frame member.

9. The lift according to claim 2 wherein the platform includes a ledge to hold a container, the platform secured to an intermediary upper frame by a hinge, the intermediate upper frame configured to be placed upon the upper frame member.

10. The lift according to claim 1 wherein the lift includes a scissor lift mechanism and a powering unit including one of a pneumatic unit, an electric unit or a hydraulic unit.

* * * * *